US006599199B1

(12) United States Patent
Hapshie

(10) Patent No.: US 6,599,199 B1
(45) Date of Patent: Jul. 29, 2003

(54) BOWLING SYSTEM FOR THE VISUALLY IMPAIRED

(76) Inventor: Thelma J. Hapshie, 10018 Bluelake Ridge, Converse, TX (US) 78109

( * ) Notice: Subject to any disclaimer, the term of this patent is extended or adjusted under 35 U.S.C. 154(b) by 0 days.

(21) Appl. No.: 10/273,263

(22) Filed: Oct. 18, 2002

(51) Int. Cl.[7] ..... A63D 5/00
(52) U.S. Cl. ..... 473/56; 473/58
(58) Field of Search ..... 273/DIG. 27; 473/55, 473/56, 58

(56) References Cited

U.S. PATENT DOCUMENTS

| | | | | |
|---|---|---|---|---|
| 2,336,997 A | | 12/1943 | Mobley | |
| 3,076,652 A | | 2/1963 | Wolff | |
| 3,082,000 A | * | 3/1963 | Holocombe | 473/58 |
| 3,178,181 A | * | 4/1965 | Burnett | 473/55 |
| 3,266,803 A | * | 8/1966 | Stahmer | 473/54 |
| 3,781,009 A | * | 12/1973 | Gagnon | 473/56 |
| 4,770,419 A | * | 9/1988 | Libby | 473/59 |

FOREIGN PATENT DOCUMENTS

| | | |
|---|---|---|
| JP | 8266706 | 10/1996 |

* cited by examiner

*Primary Examiner*—William M. Pierce
(74) *Attorney, Agent, or Firm*—Richard C. Litman

(57) ABSTRACT

A bowling system for the visually impaired includes a handle slidable upon a rope suspended between two post set in shallow plates on the floor of a bowling alley between the ball return and foul line to guide the bowler to the foul line. A metal ring having a straight arm or rope with bells attached is looped around the post closest to the foul line to signal the bowler's proximity to the foul line. A hand-held remote control device is provided for actuating audible signals from speakers suspended above the bowling lane on a support having a pair of base elements seated on the lane dividers on either side of the lane. The audible signals indicate to the bowler the direction to aim the bowling ball.

20 Claims, 6 Drawing Sheets

BOWLING SYSTEM FOR THE VISUALLY IMPAIRED

BACKGROUND OF THE INVENTION

1. Field of the Invention

The present invention relates to bowling by the blind or visually impaired. More specifically, the invention is a system used to aid blind or visually impaired bowlers to approach the foul line without going beyond it, and deliver the ball in a direction so as to knock over the most pins.

2. Description of the Related Art

Apparatus for teaching and assisting bowlers both blind and sighted have been provided in the past. These device generally assist bowlers in directing the ball down the lane. U.S. Pat. No. 2,336,997 issued Dec. 14, 1943 to Paul N. Mobley teaches a bowling instruction apparatus. The apparatus includes a sighting signal that is transversely adjustable across a bowling lane. The sighting signal is mounted above an intermediate portion of the alley and has adjusting means positioned adjacent the foul line to place the signal at a spot on the alley which the ball must pass over in order to make a strike, spare or pin. The sight is carried on a cable movably strung between two vertical supports.

In U.S. Pat. No. 3,076,652 issued Feb. 5, 1963 to Edwin F. Wolff, a device is taught that is includes a pair of vertical standards carrying a transverse supporting bar with a pivoting target supported on the bar. The bar is caused to move when struck by a bowling ball. The target is positioned across the bowling lane to point out the optimum direction of travel for the ball to obtain a strike or any particular spare. A light or audible signal is actuated by the target when moved by the bowling ball to indicate to the bowler that the target has been struck.

U.S. Pat. No. 3,082,000 issued Mar. 19, 1963 to Ralph L. Holcombe teaches an apparatus for cuing bowlers that are blind or have impaired vision. Feeler elements are mounted on a bar over the alley so as to cross the alley at right angles to its length and positioned to be activated by the bowling ball. When a feeler is struck it activates the indicator associated with it to produce audible tone. Each feeler has a different tone so that the bowlers knows from the tone where the ball is on the alley. The bowler learns to aim for spots on the alley rather than at the pins.

U.S. Pat. No. 4,770,419 issued Sep. 13, 1988 to Libby teaches a portable monorail accessory with traversable carriage for use by blind bowlers to align themselves with a bowling alley in preparing to bowl a ball. An upstanding handle on the carriage is gripped by the free hand of a bowler during his approach to delivering a bowled ball to maintain the bowler on the proper course and at the proper distance behind the foul line. In addition, Japanese patent 8266706 published Oct. 15, 1996 to Onodera Ken teaches placing voice generating means inside the ball and pins so that a pin emits a sound when standing and another when leveled which is detectable by the visually handicapped bowler.

None of the above inventions and patents, taken either singularly or in combination, is seen to describe the instant invention as claimed. Thus a visually impaired bowling system solving the aforementioned problems is desired.

None of the above inventions and patents, taken either singularly or in combination, is seen to describe the instant invention as claimed. Thus a visually impaired electrical bowling system solving the aforementioned problems is desired.

SUMMARY OF THE INVENTION

A bowling system for the visually impaired is taught for assisting blind or visually impaired bowlers in their approach to the foul line and their delivery of the bowling ball towards the pins. A guide rope assembly is mounted between a lane divider and ball return on either side of a lane designated for blind or visually impaired bowlers, for guiding the bowler toward the foul line of the lane.

The guide rope assembly includes a pair of guide posts mounted in mounting plates placed in the floor of the bowling alley. The guide rope is tied between the guide posts, and a handle is mounted for sliding along said guide rope between the guide posts. A foul line indicator assembly is operatively connected to the guide rope assembly for indicating to blind or visually impaired bowlers when they are near the foul line of the lane. The foul line indicator assembly includes a metal ring mounted around the base of the guide pole nearest the lane divider with an elongated metal rod having bells secured thereto is attached to the metal ring.

A remote control audible signaling system in the form of a hand held control unit and a remote signaling unit mounted above the lane are provided for producing audible direction tones to indicate to blind or visually impaired bowlers the portion of the lane to direct a bowling ball to obtain a strike or spare. The hand held control unit includes at least three switches for selecting which audible direction tone(s) are produced by the remote signaling unit and means for transmitting control signals.

Accordingly, it is a principal object of the invention to provide a guide rope assembly and foul line indicator assembly for a bowling lane whereby the blind or visually impaired bowler is guided towards and notified of the point for delivery of the bowling ball down the alley toward pins.

It is a further object of the invention to provide an indication to the blind or visually impaired bowler of the direction to deliver the ball down the lane toward the pins.

Still another object of the invention is to provide a system where a blind or visually handicapped bowler can be aided in play or practice with the approach to the foul line and the direction of delivery of the bowling ball down the lane towards the pins.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a system for aiding blind or visually impaired bowlers. The system consists essentially of three components: a guide rope assembly 78; a foul line indicator assembly 79; and a remote controlled audible signaling system in the form of a control unit 31 and a signaling unit 39.

Figure 1:
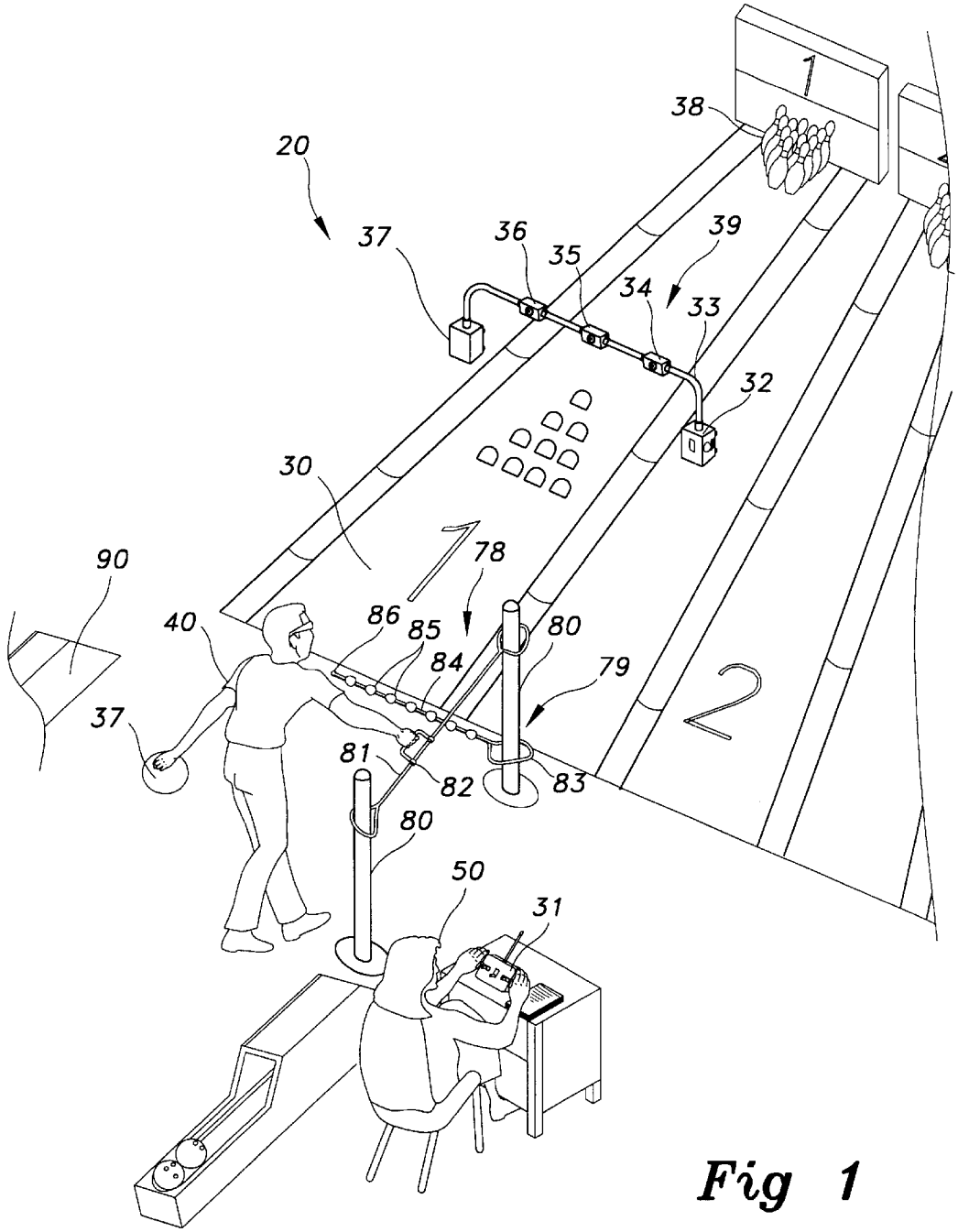
FIG. 1 is an environmental, perspective view of a bowling system for the visually impaired, according to the present invention.

As can be seen in FIG. 1, the area 20 designates a portion of a bowling alley. In general, each lane 30 of a bowling alley includes a pair of gutters and each lane is separated from adjacent lanes by a lane divider. Opposite each lane divider is a ball return. To implement the present invention, metal plates for receiving guide poles of the invention are placed in the floor adjacent the bowlers approach area 20. One floor plate is mounted adjacent the ball return, and a second floor plate is mounted adjacent the lane divider.

The guide rope assembly 78 includes a first guide pole 80 that is mounted in the floor plate which is positioned adjacent the ball return. A second guide pole 80 is mounted in the floor plate placed adjacent the lane divider. A guide rope 81 is tied between the guide poles 80 and thus arranged parallel to the path of the bowler's approach to the foul line. A handle 82 for grasping by a bowler's free hand is mounted so as to slide along the guide rope to guide the blind or visually impaired bowler 40 towards the foul line.

The foul line indicator assembly 79 includes a metal ring 83 looped around the guide pole 80 nearest the lane divider. Attached to the metal ring is a rod 84 having bells 85 secured thereto along its length. In another form of the invention, the ring can be dispensed with and the end of the rod 84 is looped around the guide pole 80.

The rod 84 is placed parallel to the foul line and spaced a few inches away. When the foot of the blind or visually impaired bowler 40 touches the rod 84, the bowler knows to stop forward movement because the foul line has been reached.

With the guide rope assembly 78 and the foul line indicator assembly 79 installed on a bowling lane the blind or visually impaired bowler 40 is guided towards and notified of the point for delivery of the bowling ball 37 toward pins 38.

To indicate to the blind or visually impaired bowler 40 the direction to deliver the ball down the lane toward the pins 38, the present invention provide a remote controlled audible signaling system which includes a control unit 31 for transmitting control signals and a signaling unit 39. The control unit 31 is in the form of a remote control device, (such as those used to remotely control model cars or other vehicles) which includes electronics for generating control signals in response to activation of signal switches 51–53 and an antenna 54 for transmitting the control signals. Control unit 31 may be a handheld unit for use by an assistant or a fixed unit secured to the guide poles 80 nearest the ball return for activation by the blind or visually impaired bowler.

Figure 2:
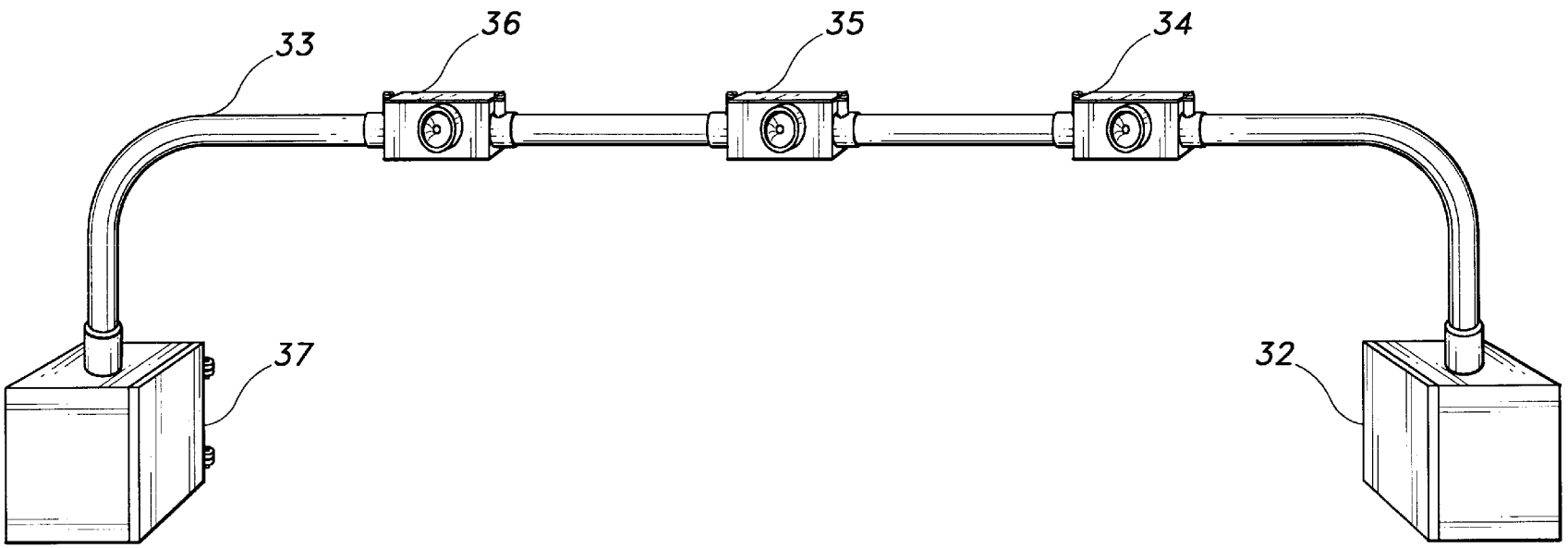
FIG. 2 is an elevational view of the signaling unit of the system for aiding blind or visually impaired bowlers according to the present invention.
Figure 3:
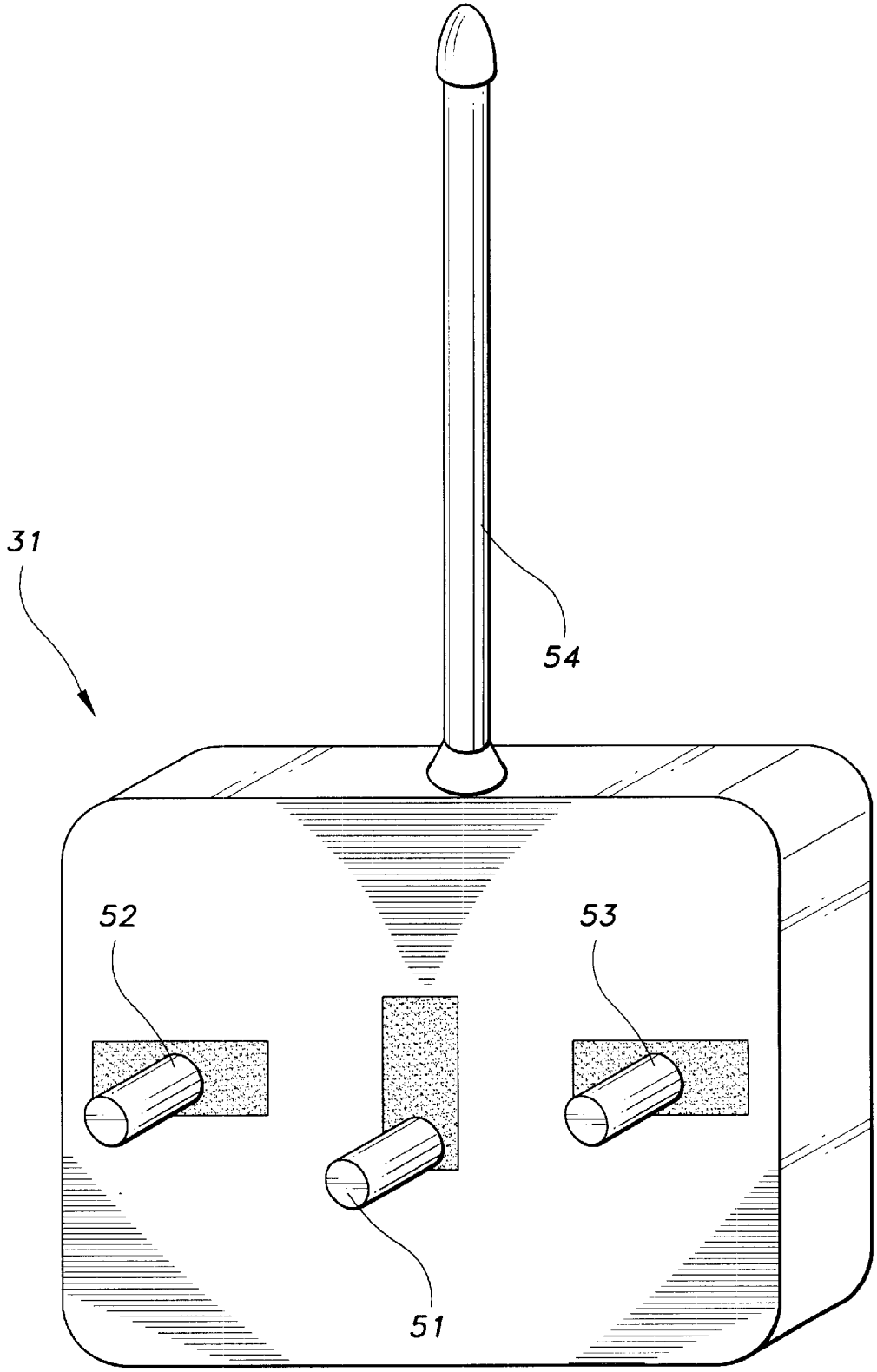
FIG. 3 is a perspective view of the control unit of the system according to the present invention.
Figure 4:
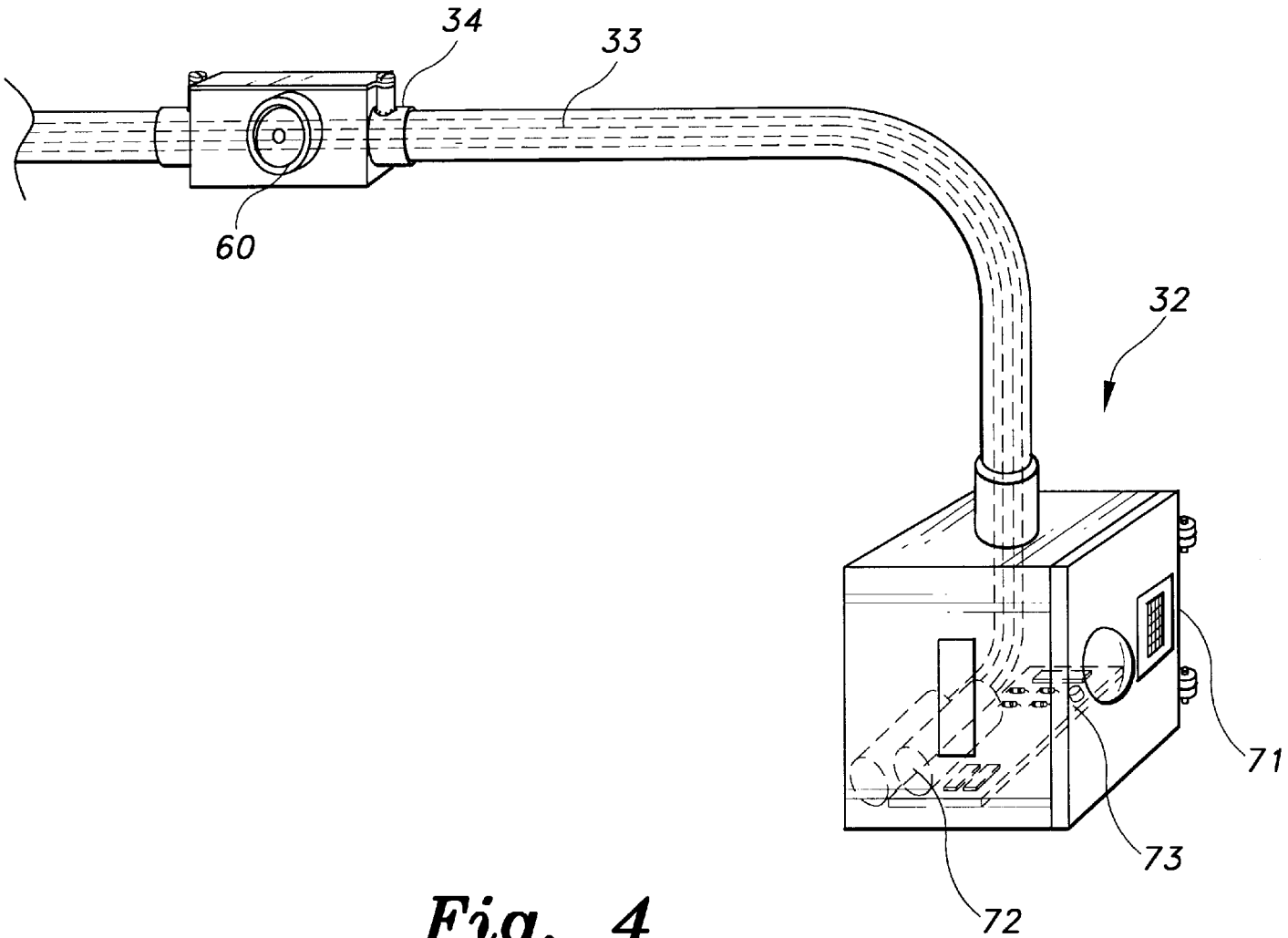
FIG. 4 is a perspective view of a base control box of signaling unit of the system according to the present invention.
Figure 5:
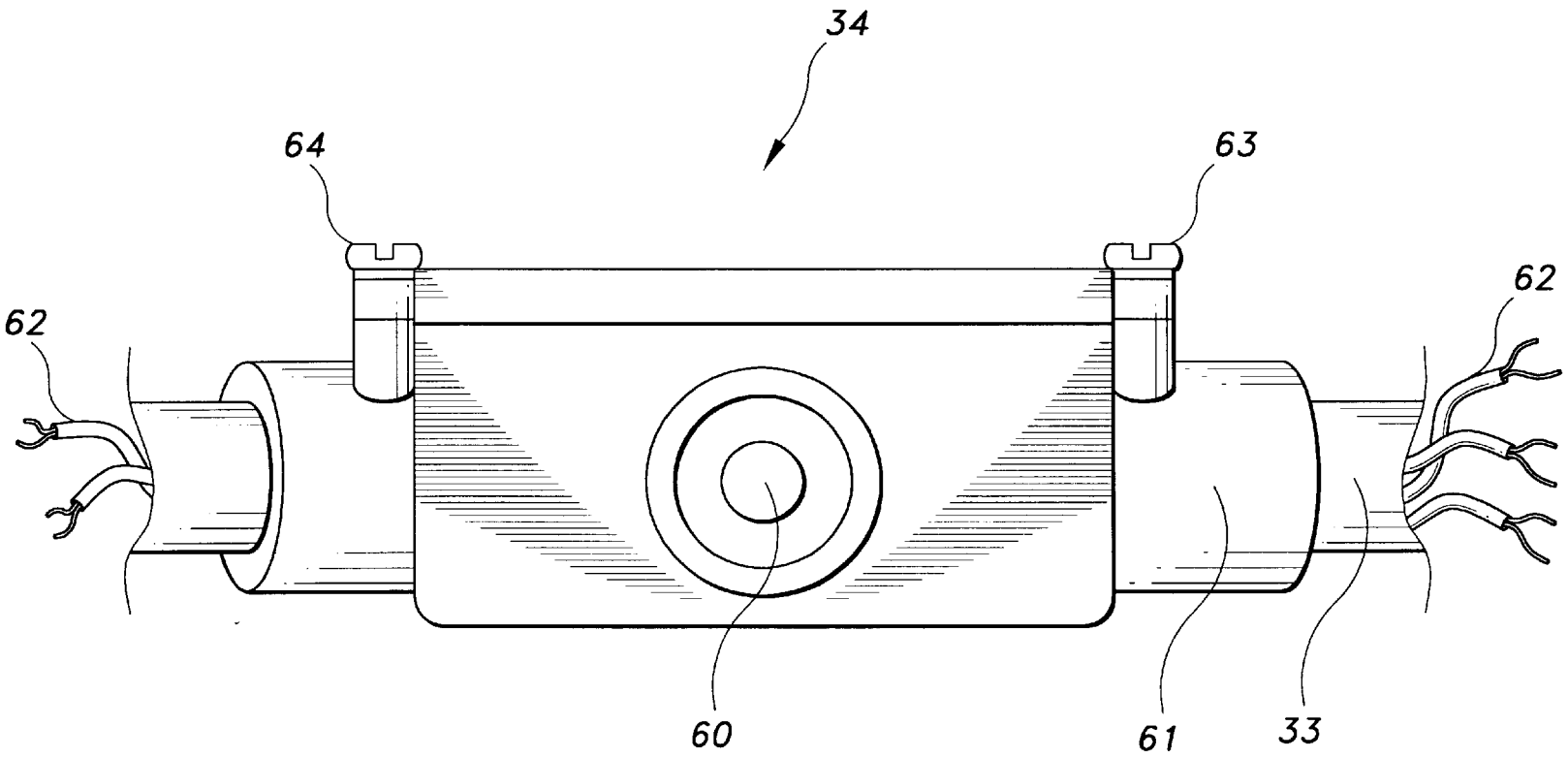
FIG. 5 is a side elevational view of a speaker housing of the signaling unit according to the present invention.
Figure 6:
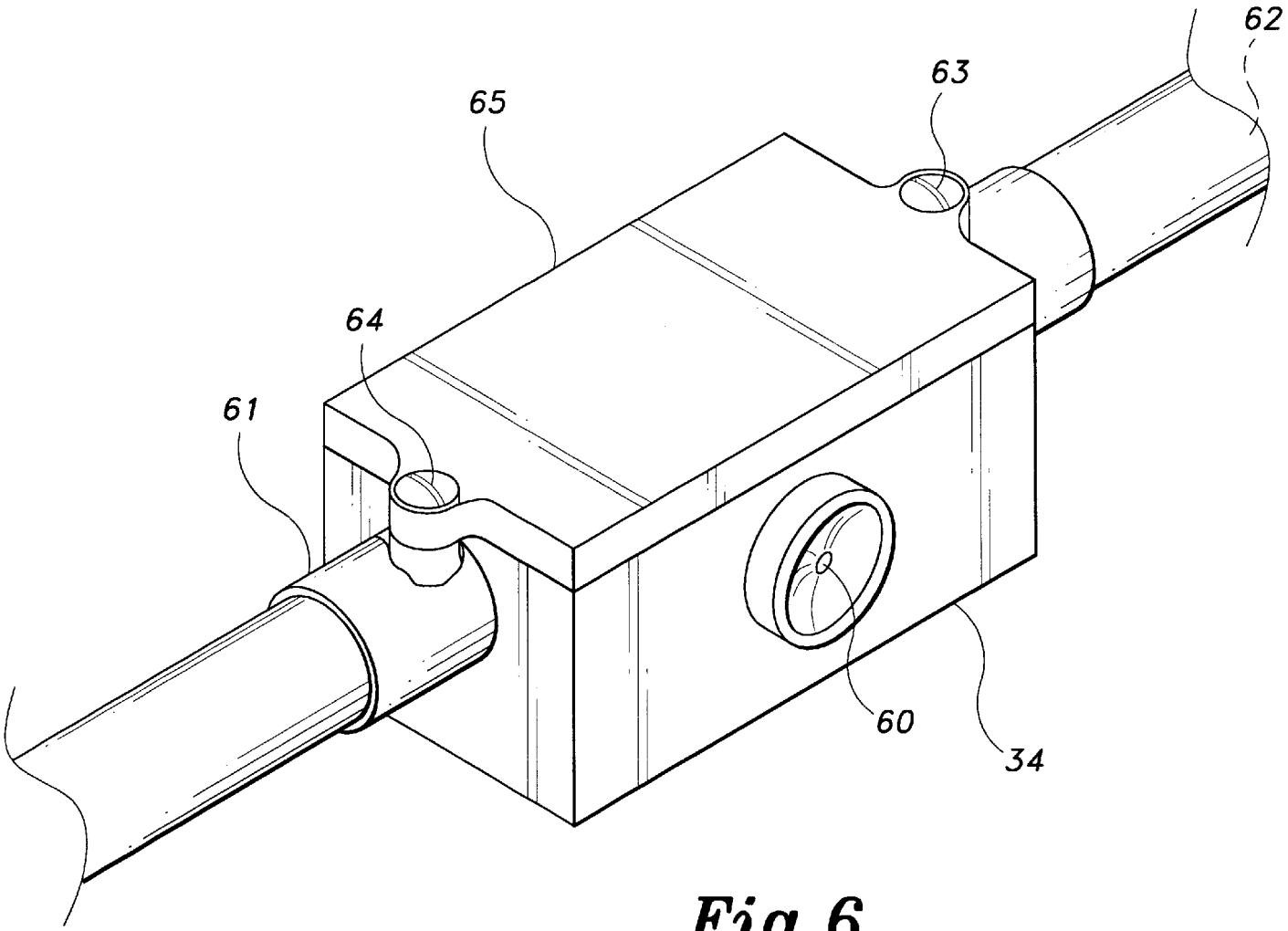
FIG. 6 is a perspective view of a speaker housing according to the present invention.

Signaling unit 39 is best seen in FIGS. 2 and 4. The signaling unit 39 includes electronics 73 for receiving the control signals and producing signals for driving audio speakers 60 attached to speaker housings 34–36. Both units contain batteries 72 (not shown in the drawings for the control unit 31) for powering the system electronics.

Speakers housings 34–36 are supported above the floor of the bowling lane slightly past the guide arrow provide on the lane surface. The speakers housings 34–36 are supported by a system of PVC piping 33 supported above the lane on legs mounted into base boxes 32 and 37. Each speaker housing 34–36 includes tubular ends 61 for receiving the piping 33 and a closure plate secured by fasteners 63 and 64. Base box 32 contains electronic means for receiving the control signals from the control unit 31 and producing signals for driving the speakers 60 in speaker housings 34–36.

A pair of wires 62 from each speaker are passed from the housings and through the piping 33 to the electronics in base box 32. Base boxes 32 and 37 are mounted on the lane dividers on both sides of the lane 30. The speaker housings 34–36 are mounted at a height above the lane 30 where the bowling ball 37 passes underneath without striking the housings 34–36 and disturbing the signaling unit 39. A strip of felt, rubber, or other non-skid material is placed on the bottom of the base boxes 32 and 37 so that the signaling unit 39 grips the floor.

The electronics of the control unit 31 and the electronic means of the signaling unit 39 cooperate to determine which of speakers 34–36 are activated to assist the blind or visually handicapped bowler. Switch 51 is used to turn on the control unit 31. Switch 52 is used to activate speaker 60 of speaker housing 35 to emit a particular tone.

A tone from speaker 60 in speaker housing 35 indicates to the bowler to direct the bowling ball 37 to pass over the center part of the lane towards the pins 38 so as to obtain a strike or knock down standing center pins to make a spare. Switch 53 is used to activate the speaker 60 of speaker housing 36 to emit a second particular tone. A tone from speaker 60 of speaker housing 36 indicates to the bowler to direct the bowling ball 37 to pass over the part of the lane to the left of the center of the lane towards the pins 38.

In the same manner, switch 53 is also used to activate speaker 60 of speaker housing 34 to emit a third particular tone. The tone from speaker housing 34 indicates to the bowler to direct the bowling ball 37 to pass over the portion of the lane to the right of the center of the lane towards pins 38. Different combinations of the three tones can be selected to indicate to the blind or visually impaired bowler 40 to aim the bowling ball 37 over the portion of the lane 30 slightly to the left or right of the center of the lane 30, i.e. down the lane between the tones toward the pins 38 to obtain a strike or pick up a spare.

Therefore, in using the remote controlled audio signaling system, a blind or visually handicapped bowler can be aided in or practice the delivery of the bowling ball towards the pins.

By using the visually impaired bowling electrical system of the present invention, a blind or visually handicapped bowler can practice or be aided in the approach to the foul line and the delivery of the bowling ball towards the pins. In this manner the pleasure of the blind or visually impaired persons' participation in bowling activity is greatly enhanced.

It would be readily understood by those of skill in the art that the signaling unit operation could be incorporated into automatic scoring programs used in bowling alleys. A tracking system may be installed above the lanes of a bowling alley for storing the signaling unit and for conveniently placing the signaling unit across any selected lane by means of electrical control.

It is to be understood that the present invention is not limited to the embodiment described above, but encompasses any and all embodiments within the scope of the following claims.

I claim:

1. A bowling system for the visually impaired comprising:

a guide rope assembly mountable between a lane divider and ball return on either side of a lane designated for blind or visually impaired bowlers for guiding blind or visually impaired bowlers towards the foul line of the lane;

a foul line indicator assembly operatively connected to the guide rope assembly for indicating to blind or visually impaired bowlers when they are near the foul line of the lane; and a remote control audible signaling system in the form of a hand held control unit and a remote signaling unit, mounted above the lane for producing audible direction tones to indicate to blind or visually impaired bowlers the portion of the lane to direct a bowling ball to obtain a strike or spare.

2. The bowling system according to claim 1, wherein said guide rope assembly includes two pole mounting plates securable in the floor of a bowling alley near the foul line and ball return of the lane.

3. The bowling system according to claim 2, wherein said guide rope assembly further includes a pair of guide posts mountable in said mounting plates, a guide rope tied between said guide posts, and a handle mounted for sliding along said guide rope between said guide posts.

4. The bowling system according to claim 3, wherein the foul line indicator assembly includes a metal ring mounted around the base of the guide pole nearest the lane divider, an elongated metal rod attached to said metal ring, and bells secured along the length of said rod.

5. The bowling system according to claim 4, wherein the hand held control unit of said remote control audible signaling system includes at least two switches for selecting which audible direction tone(s) are produced by the remote signaling unit and means for transmitting control signals.

6. The bowling system according to claim 5, wherein said remote signaling unit includes means for receiving said control, means for converting said control signals into audio signals, and means for supporting at least three speakers in speaker housings above the lane at a specified height.

7. The bowling system according to claim 6, wherein said means for supporting each of said at least three speaker housings above the lane comprises lengths of plastic piping connecting said at least three speaker housings to legs of the plastic piping attached to hollow base housings.

8. The bowling system according to claim 7, wherein said means for receiving control signals and converting them to audio signals are operatively mounted within one of said hollow base housings.

9. The bowling system according to claim 8, wherein each speaker is connected to the means for converting control signals to audio signals by a pair of wires passing through said speaker housings and said plastic tubing.

10. The bowling system according to claim 9, wherein the said control unit and said audible signaling unit further include batteries for battery operation.

11. A bowling system for the visually impaired comprising:

a guide rope assembly mountable between a lane divider and ball return on either side of a lane designated for blind or visually impaired bowlers for guiding blind or visually impaired bowlers towards the foul line of the lane;

a foul line indicator assembly operatively connected to the guide rope assembly for indicating to blind or visually impaired bowlers when they are near the foul line of the lane; and a remote control audible signaling system in the form of a hand held control unit and a remote signaling unit mounted above the lane for producing audible direction tones to indicate to blind or visually impaired bowlers the portion of the lane to direct a bowling ball to obtain a strike or spare, wherein the hand held control unit includes at least three switches for selecting which audible direction tone(s) are produced by the remote signaling unit and means for transmitting control signals.

12. The bowling system according to claim 11, wherein said remote signaling unit includes means for receiving said control, means for converting said control signals into audio signals, and means for supporting at least three speakers in speaker housings above the lane at a specified height.

13. The bowling system according to claim 12, wherein said means for supporting each of said at least three speaker housings above the lane comprises lengths of plastic piping connecting said at least three speaker housings to legs of the plastic piping attached to hollow base housings.

14. The bowling system according to claim 13, wherein said means for receiving control signals and converting them to audio signals are operatively mounted within one of said hollow base housings.

15. The bowling system according to claim 14, wherein each speaker is connected to the means for converting control signals to audio signals by a pair of wires passing through said speaker housings and said plastic tubing.

16. The bowling system according to claim 11, wherein the control unit and signaling unit further include batteries for battery operation.

17. The bowling system according to claim 12, wherein the control unit and signaling unit further include batteries for battery operation.

18. The bowling system according to claim 13, wherein the control unit and signaling unit further include batteries for battery operation.

19. The bowling system according to claim 14, wherein the control unit and signaling unit further include batteries for battery operation.

20. The bowling system according to claim 15, wherein the control unit and signaling unit further include batteries for battery operation.

* * * * *